United States Patent [19]

Brown

[11] 4,455,979

[45] Jun. 26, 1984

[54] CARBURETTORS FOR INTERNAL COMBUSTION ENGINES

[75] Inventor: Maurice L. Brown, Rewa, Via Feilding, New Zealand

[73] Assignees: Maurice Lechmere Brown; Ian Howard Batchelar; Graham Arthur Ogilvey; John Gerrad Noonan, all of Rewa, Via Feilding, New Zealand

[21] Appl. No.: 470,041

[22] Filed: Feb. 28, 1983

[30] Foreign Application Priority Data

Mar. 1, 1982 [NZ] New Zealand ..... 199858

[51] Int. Cl.[3] ..... F02P 5/00

[52] U.S. Cl. ..... 123/407; 123/406; 261/44 A; 261/44 D

[58] Field of Search ..... 123/406, 407, 434, 437; 261/44 A, 44 D, 50 A

[56] References Cited

U.S. PATENT DOCUMENTS

| | | | |
|---|---|---|---|
| 1,972,686 | 9/1934 | Lorenzeu | 261/44 D |
| 2,021,554 | 11/1935 | Jocoby et al. | 261/44 D |
| 2,559,859 | 7/1951 | Elliott et al. | 123/406 |
| 3,265,375 | 8/1966 | Morton | 261/50 A |
| 3,273,869 | 9/1966 | Morton | 261/50 A |
| 3,920,778 | 11/1975 | De Rugeris | 261/50 A |
| 4,013,050 | 3/1977 | Lace | 123/406 |
| 4,021,512 | 5/1977 | Kaufman | 261/44 A |
| 4,198,358 | 4/1980 | Mineck | 261/50 A |

*Primary Examiner*—Parshotam S. Lall
*Attorney, Agent, or Firm*—Holman & Stern

[57] ABSTRACT

A carburettor for an internal combustion engine has an air passageway in which air flow is controlled by a poppet valve in which fuel is fed from a tapered needle controlled valve readily variable for different fuels including CNG, LPG, Methanol and petrol. A movable assembly comprises the poppet valve connected to a movable wall, the latter separating a first and second pressure chamber and a low pressure control valve is manually programmable to take up a position relative to the movable assembly preferably the movable wall to control pressure in the first pressure chamber against a balancing pressure in the second pressure chamber and a biasing means to control the position of the poppet valve and the fuel valve and hence the power of an internal combustion engine on which the carburettor is fixed in accordance with selected positions of a manual control.

19 Claims, 5 Drawing Figures

CARBURETTORS FOR INTERNAL COMBUSTION ENGINES

This invention relates to carburettors for internal combustion engines.

It is an object of the present invention to provide a carburettor for an internal combustion engine which will at least provide the public with a useful choice.

Accordinglay in one aspect the invention consists in a carburettor for an internal combustion engine comprising a body, an air passageway therethrough, leading in use from ambient air to the internal combustion engine and including a venturi tube therein, a movable air control valve member in or adjacent said venturi tube and forming part of a movable assembly, a fuel control valve member associated with said air control valve member, a movable wall connected to but spaced away from said air control valve member so as to be movable therewith and so as to form part of said movable assembly, said movable wall separating a first and a second pressure chamber in said body, biasing means to bias said movable assembly to a biased position, a low pressure conduit between a part of said air passageway in which engine vacuum exists in use and said first pressure chamber, a pressure control entry to said first pressure chamber, a balancing pressure entry to said second pressure chamber, a low pressure control valve member controlling pressure from said low pressure conduit to said first pressure chamber and positionable relative to a part movable with said movable assembly and manually operable actuating means to programme positioning of said low pressure control valve member so that movement of said movable assembly relative to said low pressure control valve member due to relative forces acting on said movable assembly causes variation of pressures in said first pressure chamber and hence variation of position of said movable assembly including said air control valve member and said fuel control valve member to control power from an internal combustion engine to which the carburettor is fixed in accordance with selected positions of said manually operable actuating means.

To those skilled in the art to which the invention relates, many changes in construction and widely differing embodiments and applications of the invention will suggest themselves without departing from the scope of the invention as defined in the appended claims. The disclosures and the descriptions herein are purely illustrative and are not intended to be in any sense limiting.

One preferred form of the invention will now be described with reference to the accompanying drawings in which.

Figure 1:
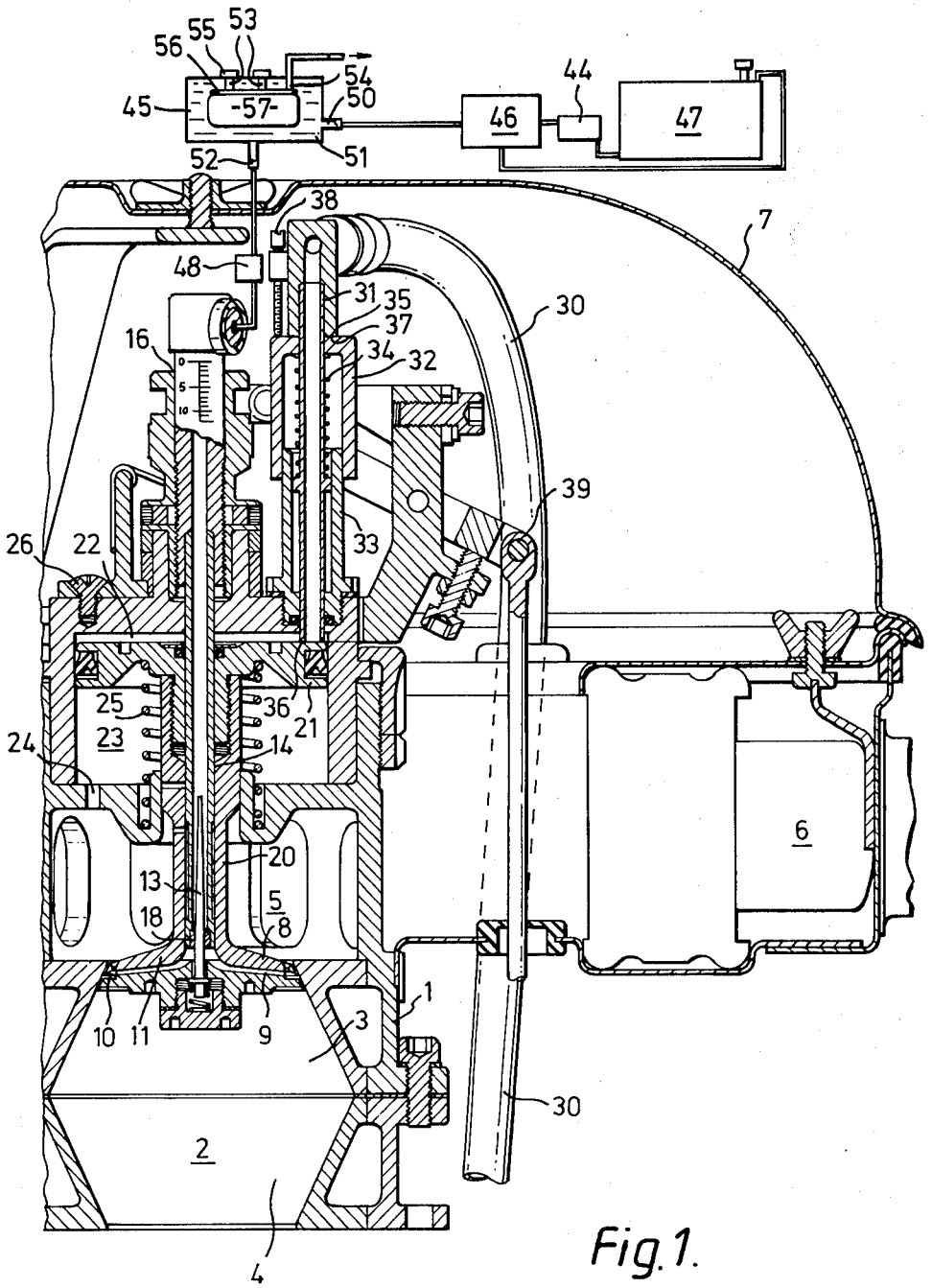
FIG. 1 is a cross section of a carburettor according to the invention, part of an air cleaner being cut away.

Referring to the drawings, a carburettor constructed according to the invention has a body 1, in which there is provided an air passageway generally referenced 2 and to provide a venturi tube therein, a coned mixture intake section 3 is connected through a reversed cone section 4 to the manifold of an internal combustion engine (not shown). Because there may be considerable evaporation of fuel in the sections 3 and 4, resulting in lowering of temperature, these sections are preferably heated by passing exhaust gases or preferably hot water from a water cooled engine cooling system through a jacket surrounding sections 3 and 4. The coned section 3 leads from an air intake 5 which is fed through an air filter shown diagrammatically at 6 and associated with the carburettor cover 7 parts of the filter 6 and cover 7 are cut away in the drawing. Mounted in the mixture intake section 3 is a movable air control valve member 8, the valve member 8 having radial passages 9 leading to a preferably annualar groove or channel 10. Such channel may be of simply annular or may be of zig-zag or undulating formation e.g. varying in diameter or in plane, and for some purposes a plurality of channels may be used. The valve is formed in two parts 11 and 12 held together with screws and the part 12 adjustable carries a jet needle 13 inserted in a fuel supply tube 14. To assist fuel flow air pasages 40 lead air from air intake 5 through air entry apertures 41 past the fuel passing from the jet 18. The fuel supply tube 14 is adjustable up and down as to engagement with the needle 13 and after adjustment is fixed by a clamp 16, fuel being supplied from a pressurized source of fuel through a movable e.g. flexible tube 17. It is a feature of the invention in the preferred form that by thihs arrangement different types of fuel may be adjusted for by adjusting the fuel pressure and/or by adjusting the fuel tube 14 up or down and it is believed that different fuels such as CNG,LPG,methanol, ethyl alcholol, gasohol and even fluid entrained solid fuel such as finely powdered coal could be supplied through the carburettor according to the invention.

Fuel is supplied to fuel supply tube 14 from the pressurized fuel supply, the pressure being determined by the viscosity and energy value of the selected fuel or blend of fuels. For petrol a standard automatic fuel pump taking supply from a petrol tank 47 is generally acceptable but for other fuels e.g. methanol or ethanol a higher presure pump is desirable. The fuel pump 44 supplies pressurized fuel preferable with the addition of a vapour separator 45, a pressure control valve 46 and a fuel shut-off valve 48.

The vapour separator 45 has a fuel inlet 50 at a suitable level in a float chamber 51 and a fuel outlet 52 in a lower part of chamber 51. Two studs 53 and the lower orifice 54 of an air vent 55 abut against a flat annular seal 56, firstly to keep the float 57 level and secondly, the float 57 acting on seal 56 controls the escape of air from above the floor through air exit 58. Such vapour laden air is then delivered by a pipe (not shown) to a convenient place e.g. air intake 5. The fuel pressure valve 46 is any proprietary pressure control valve able to control the pressure within desired limits and the fuel shut-off valve 48 may be a solenoid or a mechanically actuated valve to shut-off fuel supply completely when it is desired to shut down the engine.

Figure 2:
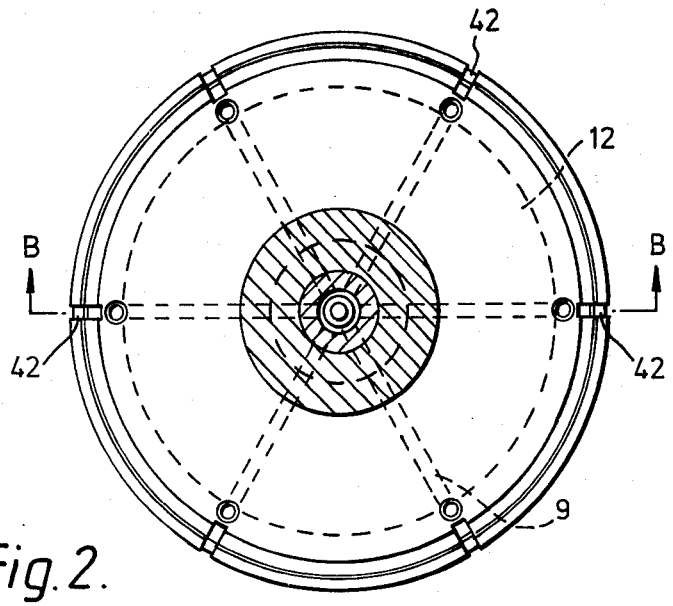
FIG. 2 is a plan view of a air control valve member according to the invention.
Figure 3:
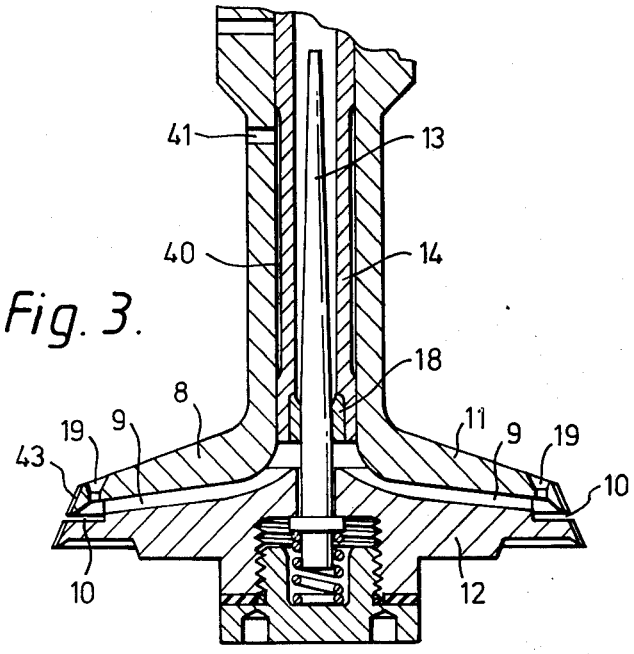
FIG. 3 is a cross section on the line B—B, FIG. 3.

Valve member 9 is shown in more detail in FIGS. 2 and 3 where the shape of the annular groove or channel 10 is shown in more detail and the jet nozzle 18 is shown which coacts with the needle 13 to give varying rates of flow of fuel as will be described further shortly. Also shown are air entry holes 19 in the air intake side of the air control valve member 8 which connect with the radial passages 9 for the purpose of accelerating and breaking up the fuel as it enters the peripheral fuel distribution channel 10. Slots or notches 42 are provided in the bevelled edge 43 preferably at the junction of the radial passages 9 and the channel 10 to assist starting and idling of the engine.

Figure 4:
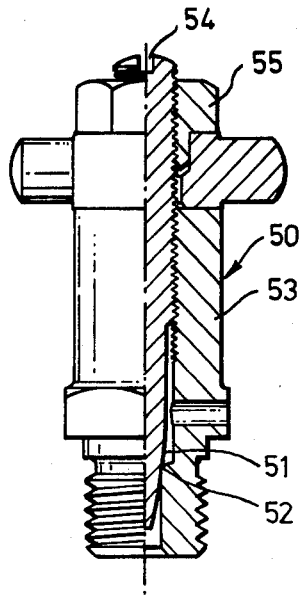
FIG. 4 is an elevation partly in section of an adjustable air valve.

To form a moving assembly the valve member 8 is connected by a valve spindle 20 to a pressure sensitive or movable wall member which may be a piston 21 operating in a piston chamber as shown or which may be a diaphragn if desired. The piston chamber is divided into a first upper chamber 22 and a second lower chamber 23. The second chamber 23 is connected by a balancing pressure entry comprising a passageway 24 to the ambient atmosphere in air intake 5. A spring or other biasing means 25 biases the piston 21 towards the chamber 22 and also biases the air control valve member 8 to a biasing position substantially closing off air entry to the engine. If desired an adjustable stop acting for example against the top of piston 21 may be provided to control the closed position. The chamber 22 has a pressure control entry comprising an air bleed hole 26 which connects ambient atmosphere with the interior of first chamber 22. Various sizes of bleed holes may be provided to tune the carburettor, but preferably an adjustable valve 50 (FIG. 4) is provided having a tapered valve member 51 acting adjacent a valve seat 52 and adjustably threaded in the body 53. A slot 54 and lock nut 55 are provided to enable adjustment and locking to be effected.

To provide manually operable actuating means to programme positioning of a low pressure control valve member, a movable, e.g. flexible tube 30 is connected to a part of the air passageway 2 in which engine vacuum exists in use, e.g. to a connecting piece (not shown) leading to the engine manifold at a position below the connecting piece 4 so that engine vacuum is supplied through a lost motion device comprising a slidable tube 31 connected to a carrier 32, the carrier 32 and tube 31 sliding on a carrier support 33. A biasing means e.g.a spring 34 is positioned between the carrier 32 and the tube 31. The lower end 36 of the tube 31 forms part of the low pressure control valve means and bears against the upper surface of the piston 21 which thus forms a valve seat for the low pressure control valve means. When the lower end 36 is in contact with the piston 21 there will be substantially no fluid flow through the tube 31. The carrier 32 is movable by a manually operable (e.g. usually operable by the accelerator in a motor vehicle) throttle linkage generally referenced 39 and pressure is transmitted from the carrier 32 through the spring 34 to the tube 31 to vary the position of that tube according to throttle demands and the position of the piston 21. The relative positions of tube 31 and carrier 32 are determined when there is no lost motion present by shoulder 35 on the tube 31 contacting shoulder 37 on the carrier 32 being held there by spring 34, or preferably by a screw 38 which adjustably varies a gap between shoulders 35 and 37. When there is lost motion present i.e. when spring 35 is compressed, by end 36 contacting the top of piston 21.

Figure 5:
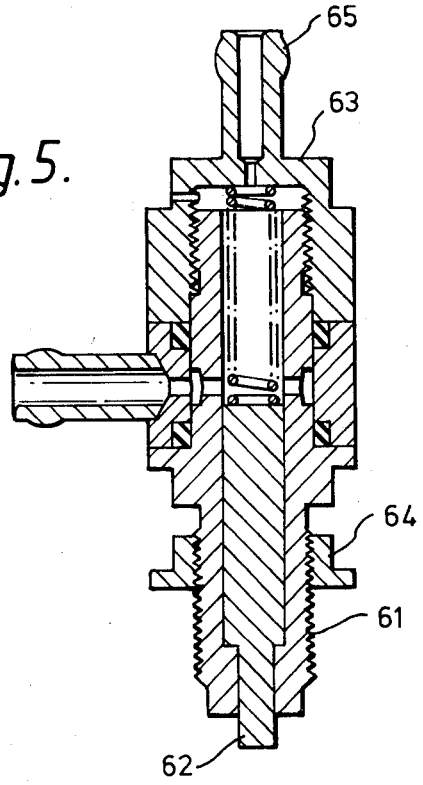
FIG. 5 is a sectional elevation of an ignition advance and retard control valve.

Preferably in air ignition advance and retard control valve is provided mounted on the body 1 by a male thread 61 (FIG. 5) so that a valve actuating member 62 is contacted by the top of piston 21 when the movable assembly is in the biased or closed disposition. The reach of the valve body 63 is adjustably locked by use of lock nut 64. The body 63 has a vacuum inlet 65 connected to engine vacuum and vacuum outlet 66 connected to an ignition advance and return mechanism such as a diaphragm (not shown). A valve member 67 is spring loaded to an open opsition by a spring 68 and when the actuation member 62 is appropriately moved by piston 21 the valve orifice 69 is closed or substantially closed stopping or reducing the vacuum applied to control the ignition advance and retard mechanism.

The operation of the construction is as follows:

The carburettor is mounted on the intake manifold of an internal combusion engine and the fuel tube 14 connected to for example a petrol supply through pump 44, vapour separator 45 and fuel shut-off valve 48 as above described.

When the engine is at rest the parts are substantially in the position shown in FIG. 1 of the drawings. When the engine is started up a vacuum will be created in the passageway 3 as a result of which the valve member 8 will be drawn downwardly against the pressure of spring 25 and against air pressure admitted to chamber 23 through the passageway 24. The vacuum is however also transmiteed through tubes 30 and 31 into the chamber 22 so that there will be some balancing effect if surface 36 of tube 31 is not in contact with the upper surface of piston 21. Because the piston 21 has a greater surface exposed to vacuum in chamber 22 than the surface of the valve member 8 exposed to vacuum in passageway 1, there will be a tendency for the position of the valve member 8 to be fixed by the positioning of the tube 31 against the upper surface of piston 21, i.e. will depend on throttle setting. This position i.e. as shown in the drawings will give minimum fuel supply i.e. idle conditions for the engine. Fuel and air supplied will depend on the position of jet 18 relative to needle 13 and air valve member 8 relative to the walls of cone 3 respectively. The fuel flow is accelerated by the flow of air from passages 40 past jet 18 and is broken up and accelerated by air flow through apertures 19 in air control valve 8. The fuel is engaged substantially evenly around the circumference of air control valve 8 by the suction of the air flow past the edge 43 thereof giving adequate atomization in the fuel mixture. It is of course an advantage that because both fuel and air are controlled by positioning the moving assembly no butterfly valve is necessary.

It if is required to increase the power supplied by the engine, the throttle linkage 39 is moved to move the carrier 32 downwardly increasing spring pressure against the tube 31 and the end 36 of the tube 31 will accordingly to programmed to close against piston 21 reducing vacuum in the chamber 22, and to stay in the closed position until all lost motion in the lost motion device is taken up. As a result the relevant forces acting on the movable assembly are as follows. There will be a greater vacuum in passageway 3 compared with chamber 22 which will overcome the air pressure in chamber 23 and spring pressure from the spring 25. As a result the positon 21 will move downawardly and the tube 31 will follow that downward movement and bleed hole 26 will maintain air pressure in chamber 22 until a position is reached where piston 21 moves away from end 36 of tube 31, i.e. all lost motion in the lost motion device has been taken up, the vacuum in passageway 2 changes due to the engine demand increasing the vacuum and as a result air will be drawn off from the first chamber 22 faster than it can be supplied through bleed hole 26. As a result there will be an equilibrium position in which it is believed that piston 21 is maintained a very short distance below the end 36 of tube 31 where the bleed-conditions in first chamber 22 maintain the valve member 8 in a constant position for that particular power setting. This power setting of course controls the position of the needle 13 relative to the fuel jet orifice 18 and the amount of air admitted to passageway 2 and thus the engine from the air intake 5.

A decrease in engine revolutions per minute through increased load on the engine while in a fixed throttle setting causes a reduction in engine vacuum resultING in a reduction in vacuum (increase in pressure) in first chamber 22 as a result of which the movable assembly moves to increase both air and fuel flow untiol equilibrium is again restored.

It will be clear from the foregoing that the invention at least in the preferred form provides the following advantages:

1. Sensitivity of control with automatic fuel and air supply increases for a particular setting of the manually operable actuating means. A reduction in engine revolutions per minute due to load increase results in reducing vacuum giving increased fuel and air valve settings.

2. Capability of being quickly adjusted to various fuels and to different sized engines by adjustment of the fuel supply jet relative to the tapered fuel supply needle.

3. Good fuel atomization and vapourization because of the radial fuel passages and peripheral fuel channel assisted by the augmentation of fuel flow by air flow over the jet and the flow of air into the peripheral channel on the periphery of the air control valve.

4. Good air flow due to the absence of a butterfly control valve in the air passage.

What is claimed is:

1. A carburettor for an internal combustion engine comprising a body, an air passageway therethrough, leading in use from ambient air to the internal combustion engine and including a venturi tube therein, a movable air control valve member in or adjacent said venturi tube and forming part of a movable assembly, a fuel control valve member associated with said air control valve member, a movable wall connected to but spaced away from said air control valve member so as to be movable therewith and so as to form part of said movable assembly, said movable wall separating a first and second pressure chamber in said body, biasing means to bias said movable assembly to a biased position, a low pressure conduit between a part of said first pressure chamber, a pressure control entry to said first pressure chamber, a balancing pressure entry to said second pressure chamber, a low pressure control valve member controlling pressure from said low pressure conduit to said first pressure chamber and positionable relative to a part movable with said movable assembly and manually operable actuating means to programme positioning of said low pressure control valve member so that movement of said movable assembly relative to said low pressure control valve member due to relative forces acting on said movable assembly causes variation of pressures in said first pressure chamber and hence variation of position of said movable assembly including said air control valve member and said fuel control valve member to control power from an internal combustion engine to which the carburettor is fixed in accordance with selected positions of said manually operable actuating means.

2. A carburettor as claimed in claim 1 wherein said manually operable actuating means include a directly movable member the position of which is manually set to a selected predetermined position by manual actuation and a lost motion device connected between said directly movable member and said low pressure control valve member so that control of pressure in said first pressure chamber by said low pressure control valve member is influenced by the presence or absence of lost motion within said lost motion device, the presence of lost motion inhibiting control of pressure in said first pressure chamber by said low pressure control valve member.

3. A carburettor as claimed in claim 2 wherein said lost motion device includes a biasing means between said directly movable member and a tube forming part of said low pressure conduit, said tube being movable relative to said directly movable member between limits provided by stops.

4. A carburettor as claimed in claim 1 wherein said low pressure control valve member comprises a member surrounding an orifice leading from said low pressure conduit and a surface of said moving wall exposed to pressure in said first pressure chamber provides a valve seat for said low pressure control valve member.

5. A carburettor as claimed in claim 1 wherein said fuel control valve member comprises a tapered needle fixed to said movable assembly which coacts with a fuel jet so that varying amounts of fuel are admitted by movement of said movable assembly and hence said tapered needle relative to said jet.

6. A carburettor as claimed in claim 5 wherein said jet is mounted on a tube and said tube is adjustable in said body to vary the setting of said jet according to the demands of selected fuels and engines.

7. A carburettor as claimed in claim 5 wherein at least one air entry air passageway and air exit are provided to cause a flow of air to pass said jet to augment flow of fuel from said jet.

8. A carburettor as claimed in claim 5 wherein fuel from said jet is passed through radial pasageways in said air control valve member to a peripherl groove on the outer edge of said air control valve member.

9. A carburettor as claimed in claim 8 wherein air entry apertures are provided adjacent the periphery of said air control valve member leading to said peripheral groove.

10. A carburettor as claimed in claim 5 wherein slots are provided adjacent the periphery of said air control valve member to admit air and fuel for starting and idling purposes.

11. A carburettor as claimed in claim 5 wherein said tapered needle is adjustable relative to said movable assembly.

12. A carburettor as claimed in claim 1 wherein said movable wall comprises a piston operating in a cylinder.

13. A carburettor as claimed in claim 1 wherein said biasing means to bias said movable assembly to a biased position comprises a spring biasing said movable assembly and thus said air control valve member to a substantially closed disposition

14. A carburettor as claimed in claim 1 wherein said pressure control entry comrises a passageway leading to atmosphere.

15. A carburettor as claimed in claim 14 wherein sid passageway is provided with an adjustable valve.

16. A carburettor as claimed in claim 1 wherein said balancing pressure entry comprises a passageway leading from said air entry.

17. A carburettor as claimed in claim 1 wherein said venturi tube comprises a coned portion of said air passageway in which a larger diameter portion is down stream of a smaller diameter portion thereof and an inverted cone portion abutting said coned portion with the larger diameter part thereof upstream of the smaller diameter part thereof.

18. A carburettor as claimed in claim 1 wherein an ignition advance and retard control valve is provided having a valve actuating member actuated by said movable assembly to restrict vacuum applied to a distributor moving means when said movable assembly is at or near said biased position.

19. A carburettor as claimed in claim 18 wherein said ignition advance and retard control valve comprises a body, a vacuum inlet and a vacuum outlet, a spring loaded vavle member actuating said valve actuating member so that when said movable assembly is at or near said biased position, said spring loaded valve member takes a substantially closed disposition.

* * * * *